US006357669B1

(12) United States Patent
Goenka et al.

(10) Patent No.: US 6,357,669 B1
(45) Date of Patent: Mar. 19, 2002

(54) NOZZLE

(75) Inventors: Lakhi Nandlal Goenka, Ann Arbor; Marc Alan Straub, Dearborn Heights; Jay D Baker, Dearborn, all of MI (US)

(73) Assignee: Visteon Global tech., Inc., Dearborn, MI (US)

( * ) Notice: Subject to any disclaimer, the term of this patent is extended or adjusted under 35 U.S.C. 154(b) by 0 days.

(21) Appl. No.: 09/470,139

(22) Filed: Dec. 22, 1999

(51) Int. Cl.[7] ..... B05B 7/06; B05B 1/28

(52) U.S. Cl. ..... 239/8; 239/290; 239/294; 239/308; 239/346; 239/340; 239/369; 239/370; 239/418; 239/427; 239/427.3; 239/429; 239/432

(58) Field of Search ..... 239/8, 290, 294, 239/346, 308, 340, 369, 370, 418, 426, 427, 427.3, 429, 430, 431, 432, 433, 434, 543

(56) References Cited

U.S. PATENT DOCUMENTS

| | | | | | |
|---|---|---|---|---|---|
| 2,029,141 | A | * | 1/1936 | Warner | 239/8 |
| 2,567,099 | A | * | 9/1951 | Buss | 239/346 |
| 2,613,999 | A | * | 10/1952 | Sher et al. | 239/434 |
| 2,770,501 | A | * | 11/1956 | Coanda | 239/429 |
| 3,285,522 | A | * | 11/1966 | Salisbury | 239/429 |
| 3,848,807 | A | * | 11/1974 | Partida | 239/290 |
| 4,413,784 | A | * | 11/1983 | Dea | 239/426 |
| 5,284,554 | A | | 2/1994 | Datta et al. | |
| 5,445,185 | A | | 8/1995 | Watanabe et al. | |
| 5,545,073 | A | | 8/1996 | Kneisel et al. | |
| 5,566,703 | A | | 10/1996 | Watanabe et al. | |
| 5,679,062 | A | | 10/1997 | Goenka et al. | |
| 5,815,181 | A | | 9/1998 | Kashino et al. | |
| 5,826,795 | A | * | 10/1998 | Holland et al. | 239/340 X |
| 5,836,150 | A | | 11/1998 | Garcia | |
| 5,901,908 | A | | 5/1999 | Goenka et al. | |
| 5,920,013 | A | | 7/1999 | Boardman et al. | |

FOREIGN PATENT DOCUMENTS

| | | |
|---|---|---|
| EP | 0501931 A | 9/1992 |
| FR | 1216427 A | 4/1960 |

* cited by examiner

*Primary Examiner*—Robin O. Evans
(74) *Attorney, Agent, or Firm*—Visteon Global tech. Inc.

(57) ABSTRACT

A nozzle 10 which receives first and second materials 24, 30 and which has an outlet aperture 18. The first material 24 is received within the outlet aperture 18 and is atomized by the second material 30 within the outlet aperture 18 before it is emitted from the nozzle 10 and applied to a targeted location and/or object 26.

17 Claims, 2 Drawing Sheets

NOZZLE

FIELD OF THE INVENTION

This invention relates to a nozzle and more particularly, to a nozzle which selectively emits a substantially fine atomized stream of material.

BACKGROUND OF THE INVENTION

Nozzles are used to selectively emit various types of material, such as and without limitation paint or other types of liquid, upon a targeted location and/or object. In order to provide an overall aesthetically pleasing appearance and to allow the material, which is typically of a liquid form, to be accurately placed or deposited upon the certain targeted location and/or object, it is desirable to cause the emitted material to form a relatively fine atomized stream or mist. The desired atomized stream and/or mist is typically achieved and/or formed by mixing the material with and/or applying an atomizing gaseous material to the material.

While prior nozzles allow for the selective emission and placement of atomized material upon such a targeted location and/or object, they do not adequately form such desired atomized streams of material. That is, many of these prior nozzles oftentimes emit "spits" or disproportionally large amounts of material due to an undesired "build up" or deposit of the material within the nozzle, thereby causing undesired and relatively high deposition concentrations of material upon the targeted object or location.

There is therefore a need for a new and improved nozzle which overcomes some or all of the previously delineated disadvantages of prior nozzles; which selectively emits relatively fine atomized streams of material; which substantially prevents the emission of "spits" of material; and which efficiently utilizes atomization gas, effective to selectively place and/or deposit material upon a targeted location and/or object.

SUMMARY OF THE INVENTION

It is a first object of the invention to provide a nozzle which overcomes some or all of the previously delineated drawbacks of prior nozzles.

It is a second object of the invention to provide a nozzle which overcomes some or all of the previously delineated drawbacks of prior nozzles and which selectively emits a relatively fine atomized spray or mist of material.

It is a third object of the invention to provide a nozzle which overcomes some or all of the previously delineated drawbacks of prior nozzles and which causes gaseous material to substantially and supersonically travel within the nozzle before atomizing liquid material, thereby creating a relatively fine atomized spray or mist of material.

According to a first aspect of the present invention a nozzle of the type which receives and which selectively emits material is provided. The nozzle has a first inlet aperture which is Selectively and communicatively coupled to the material and which selectively allows the material to be placed within the nozzle. The nozzle includes an outlet aperture through which the received material is emitted, and at least one injection member which resides within the outlet aperture and which selectively injects a second material into the outlet aperture, effective to cause the material to mix with the second material, thereby forming a material mixture which is emitted from the nozzle.

According to a second aspect of the present invention a method is provided to create a relatively fine stream of material. The method includes the steps of providing the material; providing a gaseous material; providing a cavity having an outlet aperture; causing the gaseous material to supersonically travel within the cavity and to be emitted through the outlet aperture; injecting the material within the outlet aperture, thereby causing the injected material to atomizingly mix with the supersonically traveling gaseous material, effective to form a relatively fine mist of atomized material.

These and other features, aspects, and advantages of the present invention will become apparent from a reading of the following detailed description of the preferred embodiment of the invention in combination with the accompanying drawings and the claims.

DETAILED DESCRIPTION OF THE PREFERRED EMBODIMENT OF THE INVENTION

Figure 1:
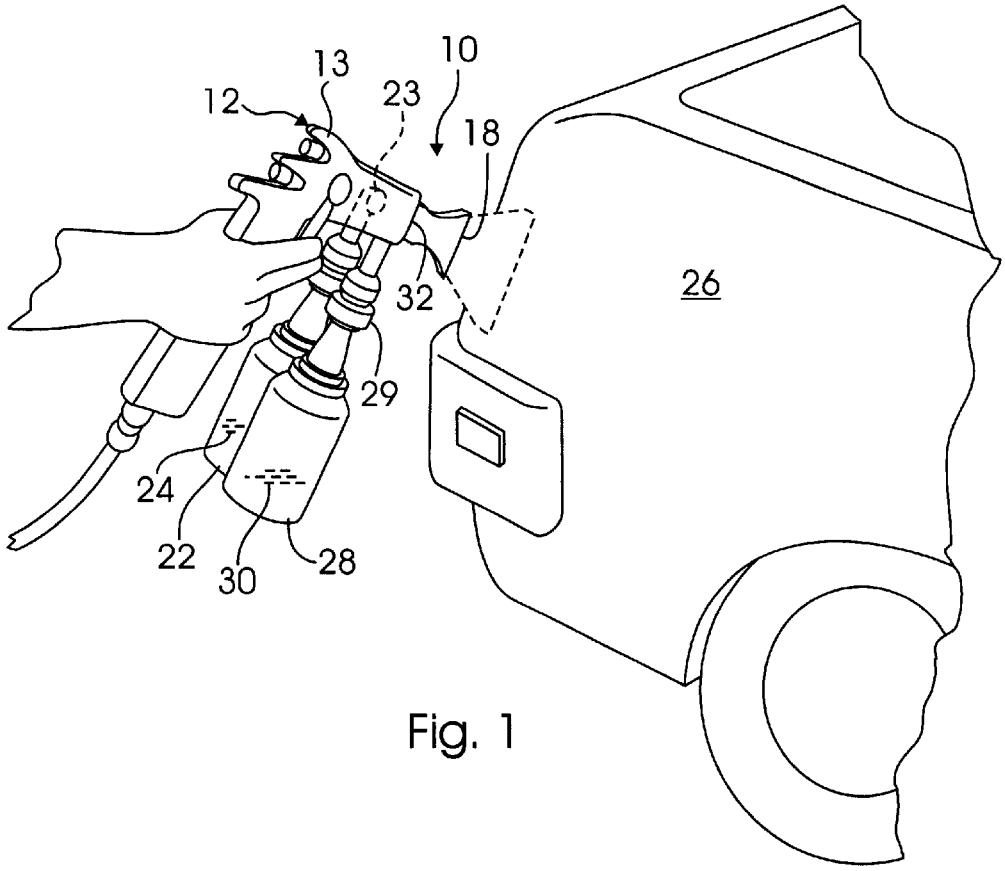
FIG. 1 is a perspective view of a material emitter which operatively employs a nozzle which is made in accordance with the teachings of the preferred embodiment of the invention.
Figure 3:
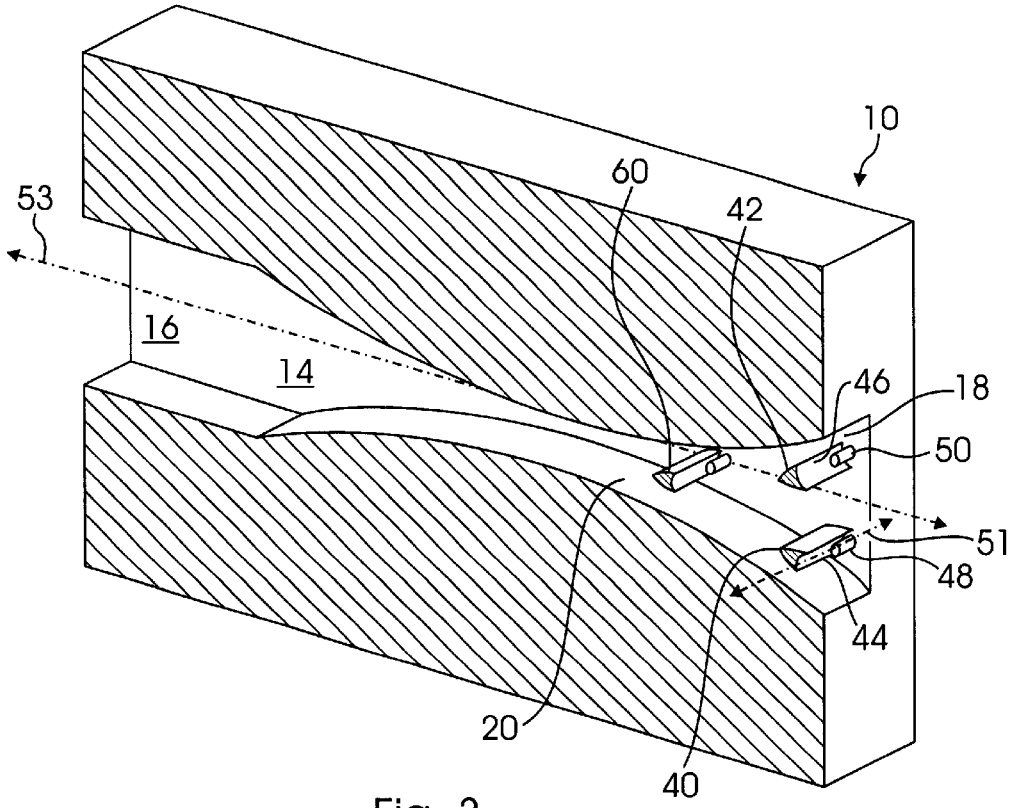
FIG. 3 is a cross sectional view of the nozzle which is shown in FIG. 2.

Referring now to FIGS. 1 and 3, there is shown a nozzle 10 which is made in accordance with the teachings of the preferred embodiment of the invention and, as should be apparent to those of ordinary skill in the art, is adapted for use upon a conventional spray gun or material emitter 12. As shown, nozzle 10 includes a generally hollow channel or cavity portion 14 having a material inlet aperture 16 and a material outlet aperture 18. Portions 16 and 18 respectively and integrally terminate within a generally constricted throat or "middle" portion 20. In one non-limiting embodiment, nozzle 10 or selected portions of nozzle 10 may be formed by a silicon micro-machining process. Further, in one non-limiting embodiment, each portion is substantially identical. In other embodiments, portions 16, 18 may be dissimilar.

Emitter 12 includes a hollow body or channel portion 13 and a first canister or source 22 of a material 24 which is to be atomized and applied to a targeted object or location, such as a portion of vehicle 26. Emitter 12 further includes a second canister or source 26 of atomizing material 30 which, in one non-limiting embodiment, comprises a gas. Body 13 forms an outlet aperture 32 which communicates with inlet aperture 16 of nozzle 10. Further, canister 28 is coupled to body 12 by tube or conduit 29 which allows the material 30 to selectively enter body 13 in a conventional and known manner. Canister 22 is coupled to nozzle 10 by use of tube or conduit 23 and emitter 12 allows material 24 to flow into nozzel 10 in a conventional and known manner.

Figure 2:
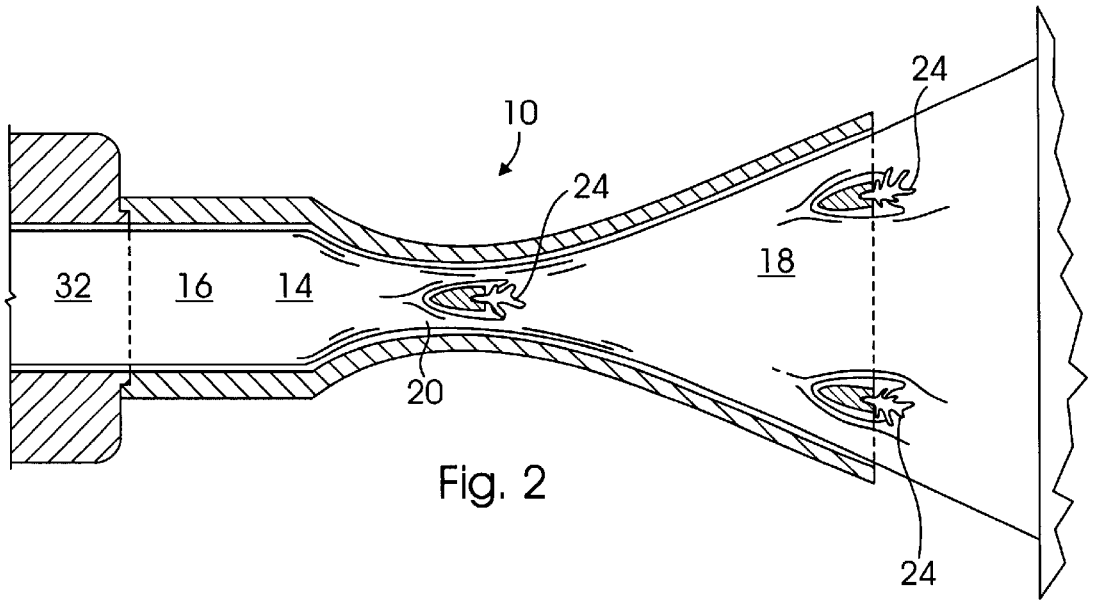
FIG. 2 is a side view of a nozzle which is made in accordance with the teachings of a first embodiment of the invention and which is shown in FIG. 1.

As further shown best in FIGS. 2 and 3, nozzle 10 includes substantially identical and generally "v"-shaped struts and/or injectors 40, 42 having respective "cupped shaped" or grooved portions 44, 46 which removably receive a respective tube or conduit 48, 50 by use of a conventional adhesive or fastener. Each conduit 48, 50 is communicatively and physically coupled by a conventional adhesive or a fastener to tube or conduit 23. A third injector member 60 may be operatively positioned within the generally constricted throat portion 20. Moreover, each injector 40, 42, and 60 has a longitudinal axis of symmetry 51 which is orthogonal and/or perpendicular to the longitudinal axis of symmetry 53 of channel 14.

In operation, the material 30 is operatively injected into body 13 and supersonically travels within the body 13, through communicating apertures 32 and 16, and through nozzle 10, until reaching the expanded output aperture 18 where injectors 40, 42, and 60 cause a second material 24 to be mixed with material 30, effective to cause the second material 24 to be atomized by the first material 30 within the outlet aperture 18. The atomized material 24 is then emitted from aperture 18.

The injection of material 24 within the outlet aperture substantially prevents undesired deposits and/or a buildup of a film of fluid within and/or upon nozzle 10, thereby substantially preventing the undesired emission of "spits" of material. Transfer efficiency (i.e., increasing the amount of the atomized material 24 which is applied to vehicle 26) may be further improved by applying an electrostatic voltage to the target 26 and/or to the emitted material 24 emanating from the nozzle 10 to aid in the adhesion of material 24 to the target.

It is to be understood that the invention is not to be limited to the exact construction and/or method which has been illustrated and discussed above, but that various changes and/or modifications may be made without departing from the spirit and the scope of the invention.

What is claimed is:

1. A nozzle having an inlet aperture which is communicatively coupled to a first material and which allows said first material to be placed within said nozzle, said nozzle further having an expanded outlet aperture through which said first material is emitted, said inlet and outlet apertures integrally terminating within a generally constricted throat portion, said nozzle further having a first injection member which resides within said outlet aperture and which injects a second material into said outlet aperture, said throat portion further having a second injection member which cooperates with said first injection member of said outlet aperture effective to cause said second material to be atomized by said first material and to be emitted from said nozzle.

2. The nozzle of claim 1 wherein said first and second injection members are substantially "v"-shaped.

3. The nozzle of claim 1 wherein said first material comprises gas.

4. The nozzle of claim 3 wherein said second material comprises paint.

5. A nozzle having a channel with a constricted throat and which is substantially symmetric about a longitudinal axis of symmetry and which forms and expanded outlet aperture, said nozzle receives a certain first material within said channel, said certain first material traversing said channel and entering said expanded outlet aperture, said nozzle further having a first and a second injector member which are disposed within said expanded outlet aperture, which are communicatively coupled to a source of a second material, and which respectively inject a portion of said second material into said expanded outlet aperture, said nozzle further having a third injector member which is disposed within said constricted throat and which cooperates with said first and said second injector members effective to cause said injected second material to be atomized by said first material within said expanded outlet aperture and to be emitted from said nozzle.

6. The nozzle of claim 5 wherein said injector members each have a longitudinal axis of symmetry which is orthogonal to said longitudinal axis of symmetry of said channel.

7. The nozzle of claim 6 wherein each of said injectors are substantially "v"-shaped.

8. The nozzle of claim 5 wherein said first material comprises a gas.

9. The nozzle of claim 8 wherein said second material comprises paint.

10. The nozzle of claim 5 wherein said injector members are substantially identical.

11. A method to apply material to an object, said method comprising the steps of:

providing a hollow member having a generally constricted middle portion and at least one open end;

providing at least a first and a second injection strut;

disposing said first injection strut within said constricted middle portion and disposing said second injection strut within said at least one open end;

injecting a first material into said hollow member;

causing said injected first material to traverse said hollow member and to be communicated to said at least one open end; and injecting a second material into said at least one open end, effective to cause said second material to be atomized and to be applied to said object.

12. The method of claim 11 wherein said step of injecting a second material into said at least one open end further comprises the steps of:

providing a tube; and coupling a first end of said tube to said first and second injection struts and a second end of said tube to said second material.

13. The method of claim 12 wherein staid strut is "V" shaped.

14. The method of claim 11 wherein said object comprises a vehicle.

15. The method of claim 14 where said second material comprises paint.

16. The method of claim 15 wherein said first material comprises gas.

17. The method of claim 11 wherein said hollow member comprises a nozzle.

* * * * *